United States Patent [19]

Adamson

[11] 4,440,421

[45] Apr. 3, 1984

[54] SKI POLE GRIP WITH ELECTRICAL HEATING

[76] Inventor: Jerome E. Adamson, 400 W. Brambleton Ave., Ste. 300, Norfolk, Va. 23510

[21] Appl. No.: 379,496

[22] Filed: May 18, 1982

Related U.S. Application Data

[62] Division of Ser. No. 198,067, Oct. 17, 1980, Pat. No. 4,343,490.

[51] Int. Cl.[3] ..... A63C 11/22

[52] U.S. Cl. ..... 280/821; 219/211

[58] Field of Search ..... 280/819, 821; 219/201, 219/204, 211, 217, 521, 527

[56] References Cited

U.S. PATENT DOCUMENTS

| | | | |
|---|---|---|---|
| 1,525,915 | 2/1925 | Charles | 219/204 |
| 3,621,191 | 11/1971 | Cornwell | 219/211 |
| 3,746,356 | 7/1973 | Shipstad | 280/821 |
| 3,874,686 | 4/1975 | Shipstad et al. | 280/821 |
| 4,021,640 | 5/1977 | Gross et al. | 219/211 |
| 4,087,675 | 5/1978 | Sansonetti | 219/211 |
| 4,278,274 | 7/1981 | Ray | 280/821 |
| 4,279,255 | 7/1981 | Hoffman | 219/211 X |

FOREIGN PATENT DOCUMENTS

| | | | |
|---|---|---|---|
| 1046889 | 12/1953 | France | 219/204 |

*Primary Examiner*—Joseph F. Peters, Jr.
*Assistant Examiner*—Michael Mar
*Attorney, Agent, or Firm*—Cushman, Darby & Cushman

[57] ABSTRACT

A ski pole hand shield is provided that includes an enclosure member of rigid highly impact-resistant material, with a hand grip disposed within the enclosure member and accessible through an access opening. A hand-warming function is provided by placing a battery in an interior portion of the hand grip and providing electric-resistance wires lining the interior of the enclosure member.

5 Claims, 6 Drawing Figures

10
12
14
16
18
20
22
24
26
32

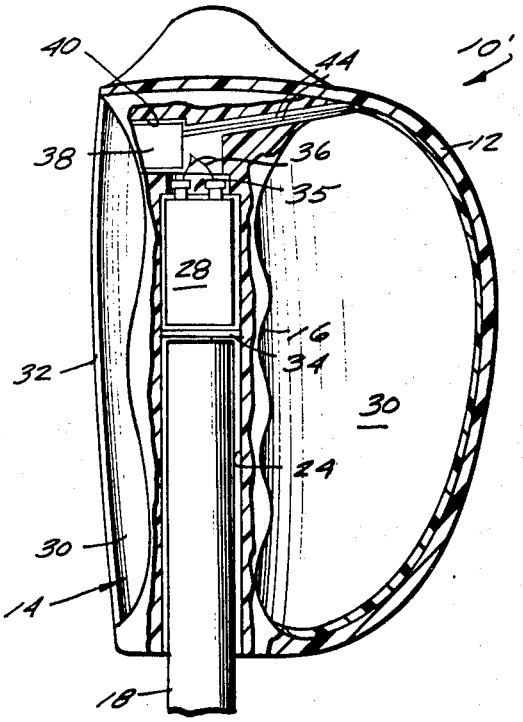
Fig. 1
Fig. 5
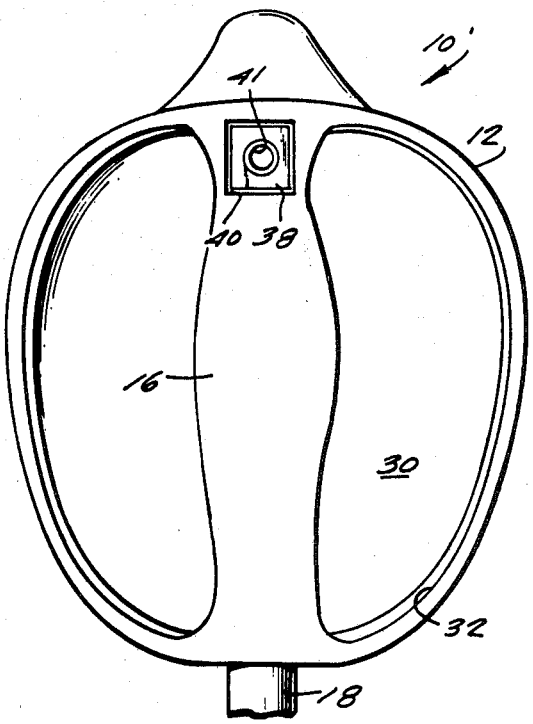
Fig. 6
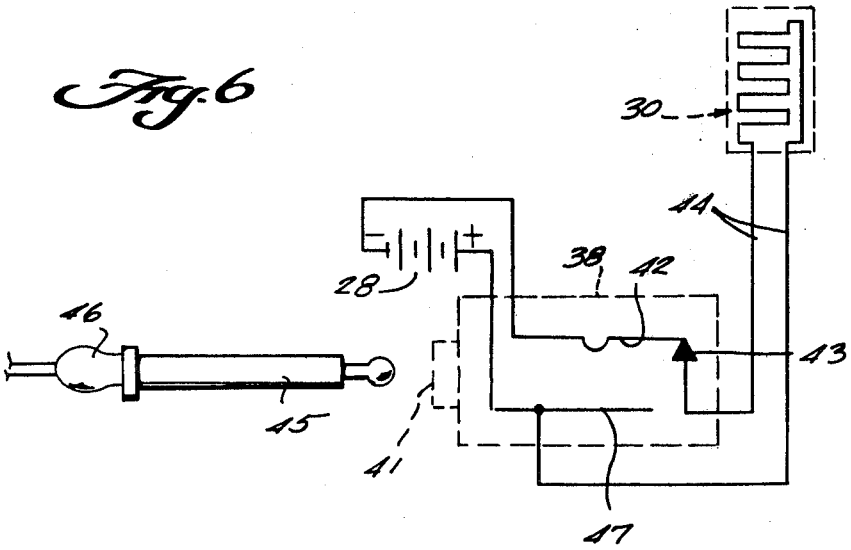

SKI POLE GRIP WITH ELECTRICAL HEATING

CROSS-REFERENCE TO RELATED APPLICATIONS

This application is a divisional of my application Ser. No. 198,067 filed Oct. 17, 1980, now U.S. Pat. No. 4,343,490, issued Aug. 10, 1982.

BACKGROUND AND SUMMARY OF THE INVENTION

Conventional ski pole grips normally comprise a handle with a strap to be looped around the skier's wrist attached to the handle. The strap keeps the ski pole from being lost should the skier release his/her grip on the ski pole. Other modifications utilize some sort of a resilient finger or strap, or utilize a guard associated with the grip, which structures take the place of the strap in allowing the skier to retain his/her grip of the ski pole during normal maneuvering, yet allowing the ski pole to be released. Other proposals facilitating maintenance of a skier's grasp on the ski pole hand grip include a flexible boot enclosing the hand grip, which boot also can provide a measure of insulation for the skier's hand to retain warmth.

While conventional arrangements for ski pole grips facilitate proper utilization of a ski pole, they normally do not provide any protection against injury to the skier's hand. While quick-release straps and strap substitutes prevent thumb avulsion injuries, according to the present invention it has been found that in most common falls the proximal interphalangeal joint of the fingers usually bears the brunt of the fall, with the tightly clinched fist holding the pole striking ice, trees, or other unyielding objects. Fractures, joint dislocations, or tendon lacerations commonly occur from such impacts. Further, the thumb, projecting out from the fist, is also vulnerable. The thumb may be forced away from its normal position adjacent the index finger with the joints, ligaments, and tendons of the thumb fractured and torn in many cases.

According to the present disclosure, a ski pole hand shield in provided that substantially eliminates the drawbacks associated with conventional ski pole hand grips. The hand shield according to the present invention provides proper protection for the thumb and the proximal interphalangeal joints of the fingers so that injury thereto does not result even if the skier falls with the ski pole tightly clenched in his/her fist. While providing this protection, the hand shield is constructed so that the ski pole can be readily released when required.

Another problem with most prior proposals for ski pole hand grips is their inability to provide any thermal protection to the hand. While a skier's hand is conventionally protected from the cold by a ski glove, the movement and physical activity associated with skiing normally increases the dissipation of heat from the hand, and the tight gripping of the ski pole by the hand reduces circulation so that the supply of heat energy is reduced. As a result, even wearing heavy gloves a skier's hands may become excessively chilled with resultant potential for frostbite or injury should a fall occur. According to the present invention, this excessive heat loss is minimized to a certain extent merely by the insulation and windbreaking functions inherent in the hand shield. However additionally because of the construction of the hand shield of the present invention, it is simple to incorporate a heating mechanism with the hand shield to provide an external source of heat for warming the skier's hands.

According to the present invention, a ski pole hand shield is provided which includes a source of electrical energy mounted within the hand shield, and means for transforming electrical energy from the source to heat so that a major portion of a skier's hand within the enclosure member is heated. The electrical energy source may comprise a battery mounted in the bore within the hand grip, with a flexible, electric-resistant element, grid affixed to, or formed integrally with, the interior surface of the enclosure member to transform electrical energy from the battery to heat. The battery may be a rechargeable battery, an electrical socket provided in the hand grip adjacent the enclosure member access opening to allow recharging of the battery.

It is the primary object of the present invention to provide a ski pole hand shield that maximizes skier hand comfort even in very cold weather, while minimizing the potential of injury to the skier's hand. This and other objects of the present invention will become clear from an inspection of the detailed description of the invention, and from the appended claims.

BRIEF DESCRIPTION OF THE DRAWINGS

FIG. 4 is a side view, partially in cross-section and partly in elevation, of a modified form of the hand shield of FIG. 1;

FIG. 5 is an end view of the hand shield of FIG. 4; and

FIG. 6 is a schematic circuit diagram illustrating the interconnection between electrical components of the hand shield of FIG. 4.

DETAILED DESCRIPTION OF THE DRAWINGS

Figures 1, 2, 3:
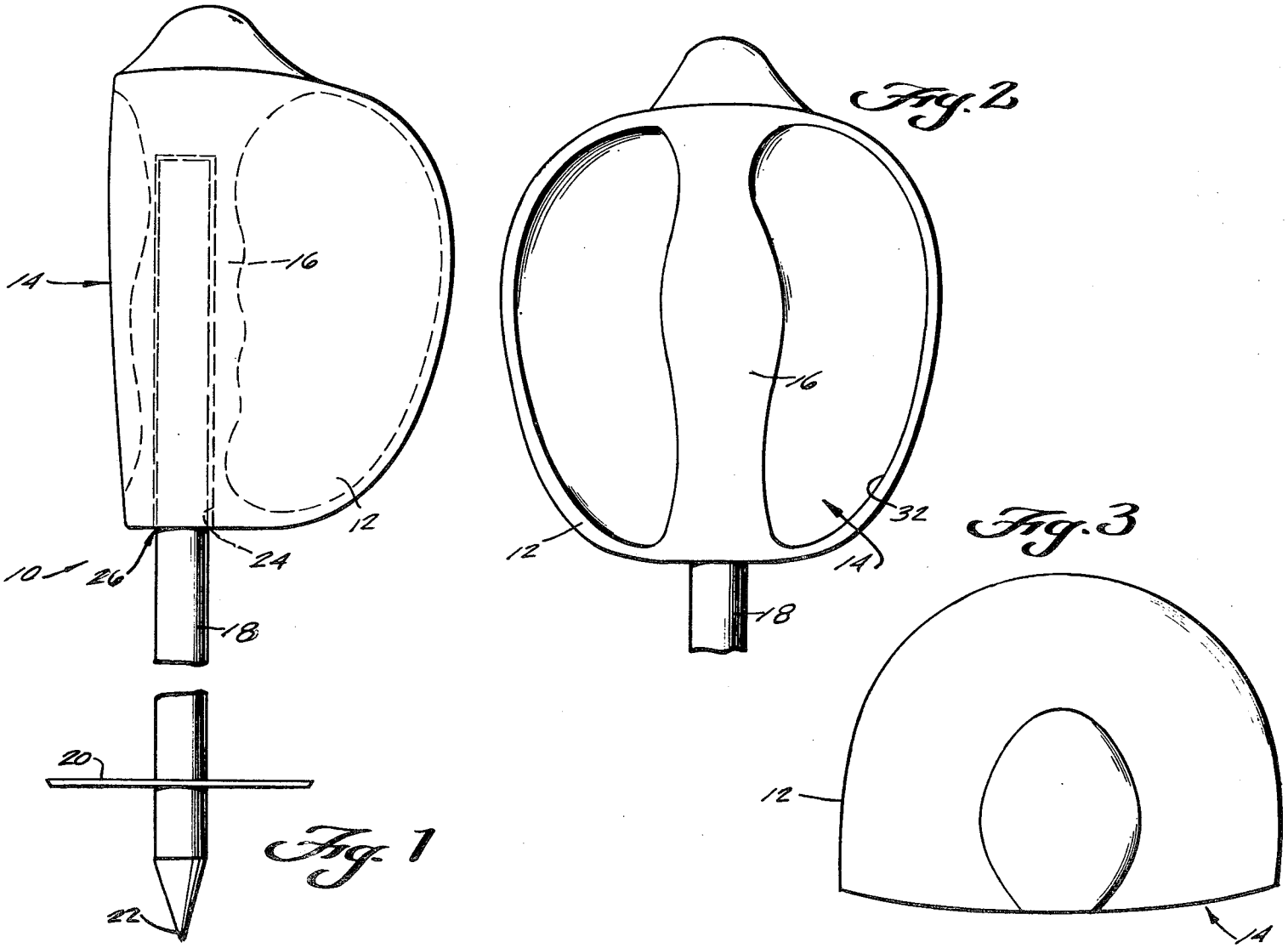
FIG. 1 is a side view of an exemplary ski pole hand shield according to the present invention, showing interior components thereof in dotted line.
FIG. 2 is an end view of the hand shield of FIG. 1.
FIG. 3 is a top plan view of the hand shield of FIG. 1.

An exemplary hand shield for a ski pole according to the present invention is illustrated generally at 10 in FIGS. 1 through 3. The device 10 includes an enclosure member 12 having means defining an access opening 14 thereto, and dimensioned to enclose a skier's hand. A hand grip 16 is disposed within the enclosure member and accessible through the access opening 14. Preferably the hand grip 16 is mounted at the access opening 14, as most clearly illustrated in FIG. 1, providing ready access to the hand grip 16 and allowing ready release of the ski pole if necessary. The shield 10 is operatively connected to a conventional ski pole 18 which conventionally includes a snow disc 20 adjacent the bottom tip 22 thereof.

In order to provide proper protection for the skier's thumb and finger interphalangeal joints, the enclosure member 12 is constructed of a rigid, highly impact-resistant material. The terms "rigid, highly impact-resistant material" as used in the present specification and claims refer to a material that will not deform or break under normal use in situations encountered during skiing, and will thus provide adequate protection for a skier's hand. Impact-resistant thermoplastic materials are preferred as the material of the enclosure member 12, such as an ABS terpolymer or resin, such as that sold under the trademark "Cyclolac T". The enclosure member 12 can have any shape allowing it to perform its function as described above, such as the shape illustrated in the drawings which may be characterized as generally corresponding to the shape of a truncated ellipsoid.

As illustrated in dotted line in FIG. 1, and as illustrated more clearly in the embodiment illustrated in FIG. 4, the hand grip 16 comprises means defining a central bore 24 therein, and an opening 26 to the central bore 24 at a first end of the grip 16. The ski pole 18 is inserted through the opening 26 into the bore 24 to be received by the hand grip 16, and may be held in place by an interference fit with the bore 24, a mechanical locking arrangement, an adhesive, or any other desirable means.

The hand shield according to the present invention is illustrated at 10' in FIGS. 4 and 5. It is substantially identical to that illustrated in FIGS. 1 through 3 except that a structure is associated therewith for providing heat to the skier's hand when disposed within the enclosure member 12. Like reference numerals in the FIGS. 4 and 5 embodiment correspond to the analogous structures in the FIGS. 1 through 3 embodiment.

The hand shield 10' includes a source of electrical energy, such a rechargeable battery 28, mounted with the hand shield 10' as well as means for transforming electrical energy from the battery 28 to heat so that a major portion of the skier's hand within the enclosure member 12 is heated. The electrical energy transforming means preferably takes the form of some sort of an electrical resistance heating wire arrangement operatively electrically connected to the battery 28. For instance, a flexible, electric-resistance element, grid 30 may be affixed to the interior surface 32 of enclosure member 12. One particular form such a structure could take is that of a silicone rubber flexible heating unit, or alternatively an etched foil heating unit may be utilized. Alternatively, instead of providing a flexible grid attached to the interior surface 32 of enclosure member 12, a grid could be formed integrally with the enclosure member 12 during construction thereof.

Preferably the battery 28 is mounted within the bore 24 formed in hand grip 16. In the form illustrated in FIG. 4, a dividing member 34 would be provided between the pole 18 and the battery 28 within the bore 24, and the bore 24 would be opened at its top (as generally illustrated at 35) with electrical wires 36 extending therefrom ultimately to the grid 30. In the preferred embodiment where the battery 28 is a rechargeable battery, an electrical socket 38 is provided electrically connected to the battery 28 and mounted in cavity 40 of hand grip 16 and adjacent the access opening 14 to enclosure member 12. A conventional recharging unit plug can be inserted through opening 42 of electrical socket 38 to provide the recharging.

FIG. 6 illustrates schematically the interconnection between the electrical components of the FIGS. 4 and 5 embodiment. As illustrated, the battery 28 is connected up to the socket 38, which contains a charging switch. The charging switch may be of the type having a cammable contact 42 normally biased into contact with stationary contact 43 to complete the circuit from battery 28 through wires 44 to the grid 30. When the tip portion 45 of recharger plug 46 is inserted through opening 40 of socket 38, it cams contact 42 out of engagement with contact 43 and a circuit is completed between stationary elongated contact 47, plug tip 45, and movable contact 42 to the battery 28. The battery 28 is then recharged by current supplied to the recharger plug 46 from any conventional external source.

An exemplary manner of construction and utilization of a ski pole hand shield according to the present invention will now be described, with particular reference to FIGS. 4 through 6.

The enclosure member 12 is formed, preferably integrally with hand grip 16 as by injection molding with plastic, with bore 24, cavity 40, and the like being formed within hand grip 16. The material of enclosure member 12 is a rigid, highly impact-resistant material such as an ABS terpolymer.

A flexible, electric-resistance element, grid 30 is adhered to at least a major portion of the interior surface 32 of enclosure member 12, as with adhesive, and is connected up by wires 44 to socket 38. Battery 28 is inserted through bore 24, and is electrically connected to socket 38, with socket 38 then inserted in cavity 40. Divider disc 34 is inserted into bore 24, and then the end of ski pole 18 opposite the snow disc 20 is inserted into bore 24, with the ski pole end and battery tightly held in place within bore 24.

When the hand shield 10' is to be utilized, the skier merely places his/her hand within the enclosure 12, holding onto the grip 16. Should the skier fall and impact his/her hand on an unyielding object, even with his/her fist tightly clenched around grip 16, the rigid, impact-resistant enclosure 12 will absorb the majority of the impact force and the chances of injury to the skier's hand will be greatly minimized. Additionally, during use, heat generated by grid 30 with energy supplied from battery 28 will warm the skier's hand.

When the hand shield 10' is not in use, recharger plug 46 may be inserted through socket opening 41 to cam movable contact 42 out of contact with stationary contact 43, and to provide recharging of battery 28. When recharging is no longer, or not, desired, a dummy plug 46 may be inserted into socket 38, or an auxiliary switch accessible from the exterior of the hand shield 10 may be provided for breaking the circuit between battery 28 and grid 30.

It will thus be seen that according to the present invention a simple ski pole hand shield has been provided which is effective to provide comfort to a skier's hand.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A ski pole hand shield comprising:

a substantially rigid enclosure member having means defining an access opening thereto, and dimensioned to enclose a skier's hand;

a hand grip disposed within said enclosure member and accessible through said access opening; wherein said hand grip comprises means defining a central bore therein and an opening to the central bore at a first end thereof; and wherein said enclosure member has an opening therein aligned with the opening and central bore of said hand grip so that an end of ski pole may be inserted through said aligned openings into said central bore and held by said hand grip;

a rechargeable battery mounted within said hand grip central bore adjacent a second end thereof, opposite said first end;

a socket electrically connected to said rechargeable battery and mounted in said hand grip adjacent said enclosure member across opening, said socket being adapted to be connected to an external source of electrical energy for recharging said battery; and means for transforming electrical energy from said battery to heat so that a major portion of a skier's hand within said enclosure may be heated.

2. A ski pole hand shield as recited in claim 1 wherein said electrical energy transforming means comprises a flexible, electric-resistance element, grid affixed to the interior surface of said enclosure member.

3. A ski pole hand shield as recited in claim 1 wherein said enclosure member has an exterior shape generally corresponding to the shape of a truncated ellipsoid, and said hand grip is disposed at said access opening.

4. A ski pole hand shield as recited in claims 1, 2 or 3 wherein said enclosure member is of, non-deformable, highly impact-resistant material.

5. A ski pole hand shield as recited in claim 4 wherein said enclosure member has an exterior shape generally corresponding to the shape of a truncated ellipsoid, and said hand grip is disposed at said access opening.

* * * * *